US011654525B2

(12) United States Patent
Genozono

(10) Patent No.: US 11,654,525 B2
(45) Date of Patent: May 23, 2023

(54) GRINDING APPARATUS

(71) Applicant: DISCO CORPORATION, Tokyo (JP)

(72) Inventor: Jiro Genozono, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/404,208

(22) Filed: Aug. 17, 2021

(65) Prior Publication Data

US 2022/0063051 A1 Mar. 3, 2022

(30) Foreign Application Priority Data

Aug. 31, 2020 (JP) ..... JP2020-145969

(51) Int. Cl.
*B24B 37/10* (2012.01)
*B24B 37/30* (2012.01)
(Continued)

(52) U.S. Cl.
CPC ..... *B24B 37/10* (2013.01); *B24B 7/04* (2013.01); *B24B 7/228* (2013.01); *B24B 37/005* (2013.01);
(Continued)

(58) Field of Classification Search
CPC ..... B24B 37/10; B24B 37/30; B24B 7/04; B24B 7/228; B24B 49/02; B24B 49/04; B24B 49/045; B24B 49/06
(Continued)

(56) References Cited

U.S. PATENT DOCUMENTS 6,168,499 B1 * 1/2001 Jang ..... B24B 7/228 451/388
2008/0070480 A1 * 3/2008 Nomiya ..... B24B 49/04 451/22
(Continued)

FOREIGN PATENT DOCUMENTS

JP 2008073785 A 4/2008
JP 2019130607 A 8/2019
(Continued)

OTHER PUBLICATIONS

IP Translated Doc WO2018235619A1 (English), (Kodama, Munehisa) Nov. 2018, [ip.com], [retrieved on Aug. 11, 2022], Retrieved from IP.com using internet <https://iq.ip.com/discover> (Year: 2018).*
(Continued)

*Primary Examiner* — Eileen P Morgan
(74) *Attorney, Agent, or Firm* — Greer, Burns & Crain, Ltd.

(57) ABSTRACT

A grinding apparatus includes a chuck table that holds a wafer on a holding surface; a grinding unit that has a spindle unit in which a spindle with an annular grindstone mounted to a tip thereof is rotatably supported and that grinds the wafer by use of the grindstone; a grinding feeding mechanism that puts the grinding unit into grinding feeding in a grinding feeding direction perpendicular to the holding surface; a first height gauge that measures the height of the holding surface; a second height gauge that measures the height of an upper surface of the wafer; and a calculation section that calculates the difference between the height of the holding surface and the height of the upper surface of the wafer, as the thickness of the wafer. In the grinding apparatus, the first height gauge and the second height gauge are disposed in the grinding unit.

4 Claims, 6 Drawing Sheets

(51) Int. Cl.

| | |
|---|---|
| ***B24B 37/005*** | (2012.01) |
| ***B24B 49/04*** | (2006.01) |
| ***B24B 49/10*** | (2006.01) |
| ***B24B 7/04*** | (2006.01) |
| ***B24B 7/22*** | (2006.01) |
| ***B24B 37/34*** | (2012.01) |

(52) U.S. Cl.
CPC ..... *B24B 37/30* (2013.01); *B24B 37/345* (2013.01); *B24B 49/045* (2013.01); *B24B 49/10* (2013.01)

(58) Field of Classification Search
USPC ..... 451/9, 10, 11
See application file for complete search history.

(56) References Cited

U.S. PATENT DOCUMENTS

2009/0247050 A1* 10/2009 Arisa ..... B24B 7/228
451/10
2020/0206868 A1* 7/2020 Owada ..... B24B 41/047
2021/0023674 A1* 1/2021 Genozono ..... B24B 37/30

FOREIGN PATENT DOCUMENTS

TW I546155 B * 5/2014
TW 202133994 A * 9/2021
WO WO-2018235619 A1 * 12/2018 ..... B24B 37/10

OTHER PUBLICATIONS

IP Translated Doc JP 2019-13067 (Japanese, Junsoo). Aug. 2019, [ip.com], [retrieved on Aug. 18, 2022], Retrieved from IP.com using internet <https://iq.ip.com/discover> (Year: 2019).*

* cited by examiner

GRINDING APPARATUS

BACKGROUND OF THE INVENTION

Field of the Invention

The present invention relates to a grinding apparatus.

Description of the Related Art

As disclosed in Japanese Patent Laid-open No. 2008-073785 and Japanese Patent Laid-open No. 2019-130607, a grinding apparatus for grinding a wafer held by a holding surface of a chuck table includes a first height gauge that measures the height of the holding surface, a second height gauge that measures the height of an upper surface of the wafer, and a calculation section that calculates the difference between the height of the holding surface measured by the first height gauge and the height of the upper surface of the wafer measured by the second height gauge, as the thickness of the wafer, and in the grinding apparatus, grinding is conducted until a predetermined thickness is reached while the thickness of the wafer is calculated.

For example, as illustrated in FIG. 5, a first height gauge 61 and a second height gauge 62 included in a conventional grinding apparatus are supported on a column member 70 erected on a base 10 on which a chuck table 2 and a grinding unit 3 are disposed, through an arm 71, and the height of a wafer 17 is measured at a position spaced from a processing region where grindstones 340 and the wafer 17 come into contact with each other. Although the arm 71 extending in a horizontal direction from a column is provided such that the height can be measured at a position close to the processing region, lengthening the arm 71 generates such a problem that it becomes difficult to accurately measure the thickness due to thermal deformation or the like in the arm 71. As a countermeasure, for example, as depicted in FIG. 6, an arm 72 may be provided on a column 11 on which a grinding feeding mechanism 4 for grinding feeding of the grinding unit 3 in the vertical direction is supported, and the arm 72 may be made short.

SUMMARY OF THE INVENTION

However, according to the abovementioned method, though the arm can be made short, it cannot be said that the thickness of the wafer can be accurately measured. The provision of the arm is considered to have a bad influence on measurement of the thickness of the wafer.

Accordingly, it is an object of the present invention to provide a novel grinding apparatus with which the thickness of the wafer can be accurately measured.

In accordance with an aspect of the present invention, there is provided a grinding apparatus including a chuck table that holds a wafer on a holding surface; a grinding unit that has a spindle unit in which a spindle with an annular grindstone mounted to a tip thereof is rotatably supported and that grinds the wafer by use of the grindstone; a grinding feeding mechanism that puts the grinding unit into grinding feeding in a grinding feeding direction perpendicular to the holding surface; a first height gauge that measures a height of the holding surface; a second height gauge that measures a height of an upper surface of the wafer held on the holding surface; and a calculation section that calculates a difference between the height of the holding surface measured by the first height gauge and the height of the upper surface of the wafer measured by the second height gauge, as a thickness of the wafer. In the grinding apparatus, the first height gauge and the second height gauge are disposed in the grinding unit.

Preferably, the grinding unit includes a holder having a support plate that has an opening for exposing a lower portion of the spindle and that supports the spindle unit and a side plate erected from a periphery of the support plate, and the first height gauge and the second height gauge are disposed on the side plate such that a first measurement point of the first height gauge and a second measurement point of the second height gauge are positioned in the vicinity of a processing region where the grindstone grinds the wafer.

In addition, preferably, when the grinding unit is lowered in a direction for approaching the holding surface by the grinding feeding mechanism, the first height gauge measures the height of the holding surface and the second height gauge measures the height of the upper surface of the wafer, before the grindstone comes into contact with the wafer.

In the grinding apparatus according to one aspect of the present invention, the first measurement point and the second measurement point can be positioned in the vicinity of the processing region where the upper surface of the wafer and the lower surface of the grindstone come into contact with each other, and, thus, the thickness of the wafer that is obtained immediately after grinding has started can be accurately measured, and fine variation in the thickness of the wafer that is recognized immediately after grinding has started can be recognized.

In addition, in the case where the first height gauge and the second height gauge are disposed on the side plate of the holder, it is possible, by causing the grindstone to approach the upper surface of the wafer by use of the grinding feeding mechanism, to simultaneously lower the first height gauge and the second height gauge. Further, since both height gauges are separated away from the upper surface of the wafer together with the grindstone when the grindstone is spaced away from the upper surface of the wafer by use of the grinding feeding mechanism, operability of maintenance work and the like can be enhanced.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

An embodiment of the present invention will be described below with reference to the attached drawings.

1. Configuration of Grinding Apparatus

Figure 1:
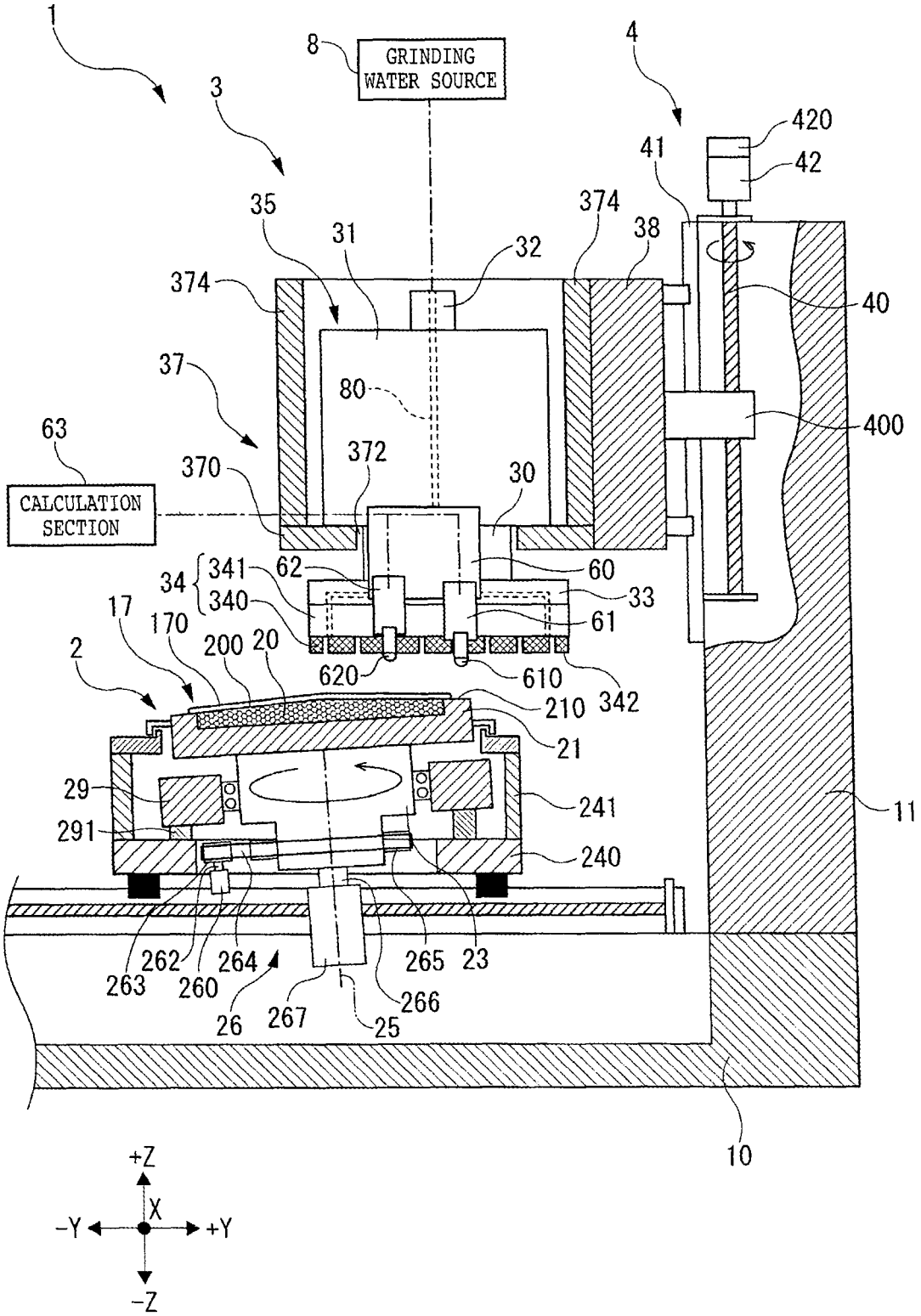
FIG. 1 is a sectional view of a grinding apparatus before the start of grinding a wafer.

A grinding apparatus 1 illustrated in FIG. 1 is a grinding apparatus for grinding a wafer 17 by use of a grinding unit 3. The configuration of the grinding apparatus 1 will be described below.

As depicted in FIG. 1, the grinding apparatus 1 includes a base 10 extending in a Y-axis direction and a column 11 erected on a +Y direction side of the base 10.

A chuck table 2 is disposed on the base 10. The chuck table 2 includes a suction section 20 that has a porous member and a frame body 21 that supports the suction section 20. An upper surface of the suction section 20 is a holding surface 200 that holds the wafer 17, and is formed in a comparatively gentle conical surface. In addition, an upper surface 210 of the frame body 21 is formed flush with the holding surface 200.

An unillustrated suction source is connected to the holding surface 200. With the suction source operated, a suction force generated is transmitted to the holding surface 200. For example, in a state in which the wafer 17 is mounted on the holding surface 200, the suction force generated by operation of the suction source is transmitted to the holding surface 200, whereby the wafer 17 can be held under suction on the holding surface 200. In this instance, the wafer 17 is held on the holding surface 200 so as to be along the conical surface of the holding surface 200, so that, in the state in which the wafer 17 is held on the holding surface 200, an upper surface 170 of the wafer 17 is substantially conical in shape.

The chuck table 2 is detachably mounted to a base 23. The base 23 is rotatably supported by an annular connection member 29, and the connection member 29 is supported by three support shafts 291 (two of which are depicted in FIG. 1) erected on a support member 240.

The support member 240 is opened, and a rotating mechanism 26 that rotates the chuck table 2 is disposed at the opening part of the support member 240. The rotating mechanism 26 is, for example, a pulley mechanism, and includes a driving shaft 262 configured to be rotatable by a motor 260 around an axis 25 substantially in a Z-axis direction, a driving pulley 263 connected to an upper end of the driving shaft 262, a transmission belt 264 that is wound around the driving pulley 263 to transmit a driving force of the driving pulley 263 to a driven pulley 265, the driven pulley 265 wound by the transmission belt 264 together with the driving pulley 263, a driven shaft 266 connected to the driven pulley 265, and a rotary joint 267 connected to a lower end of the driven shaft 266. The driven shaft 266 is connected to the base 23.

When the driving shaft 262 is rotated by use of the motor 260, the driving pulley 263 is rotated, and a rotating force of the driving pulley 263 is transmitted by the transmission belt 264 to the driven pulley 265, whereby the driven pulley 265 is rotated. As a result, the driven shaft 266 connected to the driven pulley 265 is rotated around the axis 25, to rotate the base 23 connected to the driven shaft 266 and the chuck table 2 mounted to the base 23, around the axis 25.

On a side surface on a −Y direction side of the column 11, a grinding feeding mechanism 4 that puts the grinding unit 3 into grinding feeding in a grinding feeding direction perpendicular to the holding surface 200 is disposed.

The grinding unit 3 includes a spindle unit 35 having a spindle 30 having an axis in the Z-axis direction, a spindle housing 31 supporting the spindle 30 in a rotatable manner, and a spindle motor 32 driving, in a rotational manner, the spindle 30 around an axis in the Z-axis direction.

In addition, the grinding unit 3 includes a mount 33 connected to a lower end of the spindle 30 and a grinding wheel 34 detachably mounted to a lower surface of the mount 33.

The grinding wheel 34 includes a wheel base 341 and a plurality of substantially rectangular parallelepiped grindstones 340 arranged in an annular pattern on a lower surface of the wheel base 341. Lower surfaces 342 of the grindstones 340 are grinding surfaces that come into contact with the wafer 17.

With the spindle 30 is rotated by use of the spindle motor 32, the mount 33 connected to the spindle 30 and the grinding wheel 34 mounted to the lower surface of the mount 33 are rotated as one body.

In addition, the spindle 30, the mount 33, and the wheel base 341 are formed with a grinding water channel 80 in a penetrating manner. The grinding water channel 80 is connected to a grinding water source 8, and, with grinding water supplied from the grinding water source 8, the grinding water is passed through the inside of the spindle 30, the mount 33, and the wheel base 341 to be supplied through the lower end of the wheel base 341 to the lower side of the grindstones 340.

For example, supplying the grinding water from the grinding water source 8 during grinding of the wafer 17 to a portion between the lower surfaces 342 of the grindstones 340 and the upper surface 170 of the wafer 17 makes it possible to cool the grindstones 340 and clean the swarf generated on the upper surface 170 of the wafer 17 and the like, with running water.

The grinding unit 3 includes a holder 37 which has a support plate 370 having an opening 372 for exposing a lower portion of the spindle 30 on the lower side; and a side plate 374 erected on a peripheral portion of the support plate 370. The support plate 370 supports the spindle housing 31.

The grinding feeding mechanism 4 includes a ball screw 40 having a rotational axis in the Z-axis direction, a pair of guide rails 41 disposed in parallel to the ball screw 40, a Z-axis motor 42 for rotating the ball screw 40, and an encoder 420 for measuring the rotation amount of the ball screw 40 rotated by the Z-axis motor 42. The ball screw 40 is in screw engagement with a nut 400, and a slider 38 is connected to the nut 400. In addition, the slider 38 supports the side plate 374.

When the ball screw 40 is driven by the Z-axis motor 42 and the ball screw 40 is rotated, the nut 400 in screw engagement with the ball screw 40 is lifted upward or downward in the Z-axis direction while sliding on the ball screw 40. Attendant on this, the slider 38 connected to the nut 400 is lifted upward or downward in the Z-axis direction while being guided by the guide rails 41, whereby the grinding unit 3 is moved in the Z-axis direction.

A connection section 60 is supported by the side plate 374 of the holder 37, and the first height gauge 61 and the second height gauge 62 are supported by the connection section 60. A first contact element 610 making contact with the upper surface 210 of the frame body 21 is provided at a lower portion of the first height gauge 61, and a second contact element 620 making contact with the upper surface 170 of the wafer 17 is provided at a lower portion of the second height gauge 62.

By bringing the first contact element 610 of the first height gauge 61 into contact with the upper surface 210 of the frame body 21, it is possible to measure the height of the holding surface 200 which is flush with the upper surface 210 of the frame body 21. In addition, by bringing the second contact element 620 of the second height gauge 62 into contact with the upper surface 170 of the wafer 17, it is possible to measure the height of the upper surface 170 of the wafer 17.

The first contact element 610 and the second contact element 620 are disposed at positions lower than the lower surfaces 342 of the grindstones 340. Thus, when the grinding unit 3 is moved in a −Z direction by use of the grinding feeding mechanism 4 in a state in which the wafer 17 is held on the holding surface 200, the first contact element 610 comes into contact with the upper surface 210 of the frame body 21 and the second contact element 620 comes into contact with the upper surface 170 of the wafer 17 before the grindstones 340 come into contact with the upper surface 170 of the wafer 17.

As depicted in FIG. 1, the first height gauge 61 and the second height gauge 62 are connected to a calculation section 63. The calculation section 63 is, for example, a calculating device having a central processing unit (CPU), a memory, and the like, and has a function of calculating the difference between the height value of the holding surface 200 measured by the first height gauge 61 and the height value of the upper surface 170 of the wafer 17 measured by the second height gauge 62, as the thickness of the wafer 17.

A first measurement point 611 which is a point where the first contact element 610 of the first height gauge 61 and the upper surface 210 of the frame body 21 come into contact each other and a second measurement point 621 which is a point where the second contact element 620 of the second height gauge 62 and the upper surface 170 of the wafer 17 held on the holding surface 200 come into contact each other are located in the vicinity of a processing region 9 where the lower surfaces 342 of the grindstones 340 and the upper surface 170 of the wafer 17 come into contact with each other in a positional relation of horizontal positions. Here, the vicinity of the processing region 9 is a position sufficiently close to the processing region 9 within such a range that interference with the grindstones 340 is not caused during grinding.

2. Operation of Grinding Apparatus

At the time of grinding the wafer 17 by use of the grinding apparatus 1, first, the wafer 17 is mounted on the holding surface 200 of the chuck table 2, and thereafter, the suction source connected to the holding surface 200 is operated. As a result, a suction force generated by the suction source is transmitted to the holding surface 200, whereby the wafer 17 is held under suction by the holding surface 200. Then, for example, the chuck table 2 is rotated in the direction of an arrow 27 depicted in FIG. 2.

Figure 2:
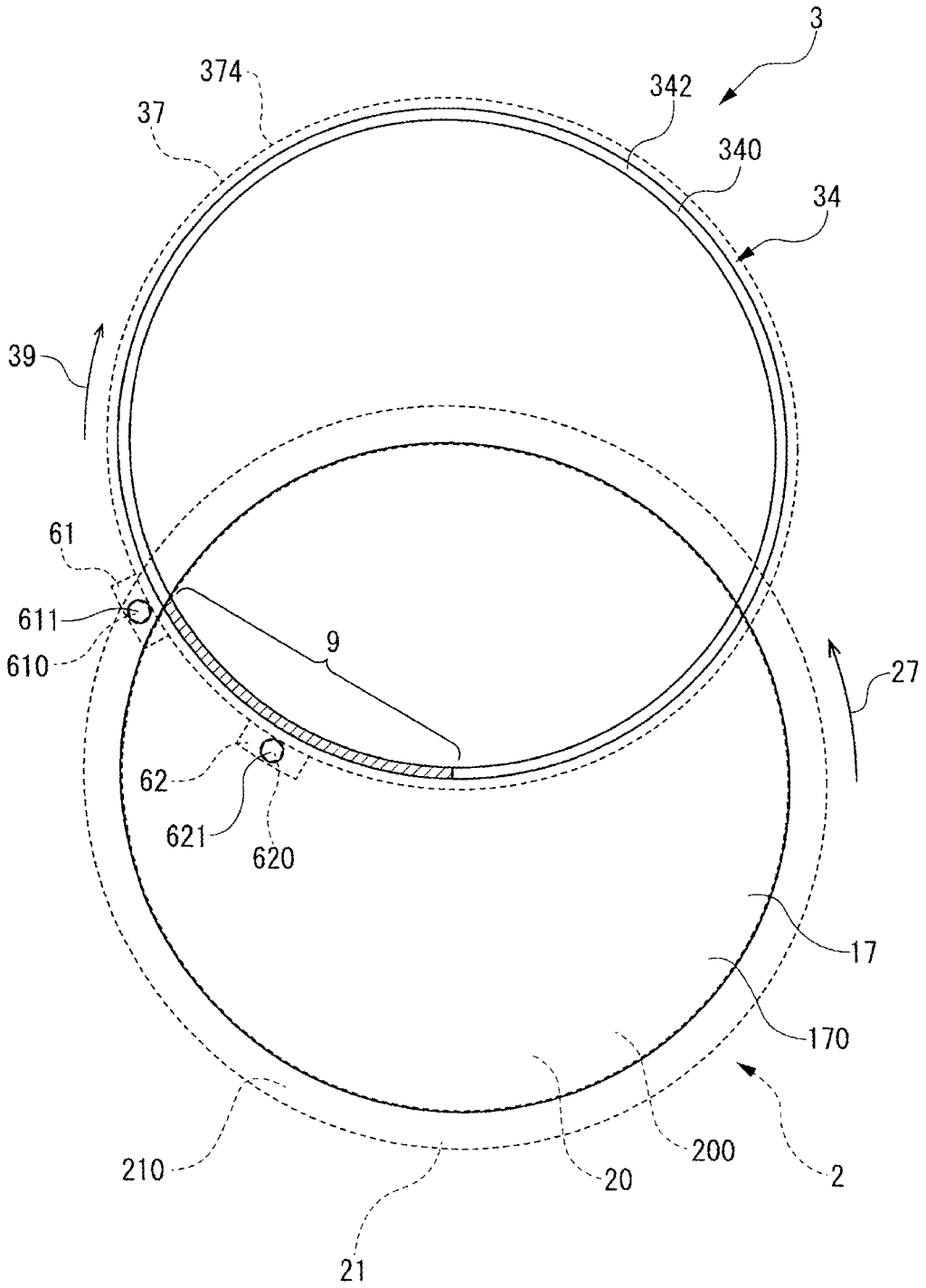
FIG. 2 is a plan view depicting the relation of horizontal positions of a first measurement point, a second measurement point, and a processing region.

In addition, for example, the grindstones 340 are preliminarily rotated in the direction of an arrow 39 depicted in FIG. 2. Then, in a state in which the grindstones 340 are rotating, the grindstones 340 are lowered in the direction of approaching the holding surface 200, by use of the grinding feeding mechanism 4.

In this instance, since the first contact element 610 and the second contact element 620 are disposed at positions lower than the grindstones 340, the first contact element 610 comes into contact with the upper surface 210 of the frame body 21 and the second contact element 620 comes into contact with the upper surface 170 of the wafer 17 before the grindstones 340 come into contact with the upper surface 170 of the wafer 17.

As a result, the height of the holding surface 200 is measured by the first height gauge 61, and the height of the upper surface 170 of the wafer 17 is measured by the second height gauge 62.

Then, the height value of the holding surface 200 and the height value of the upper surface 170 of the wafer 17 thus measured are transmitted to the calculation section 63, and the thickness of the wafer 17 that is yet to be ground is calculated.

Figure 3:
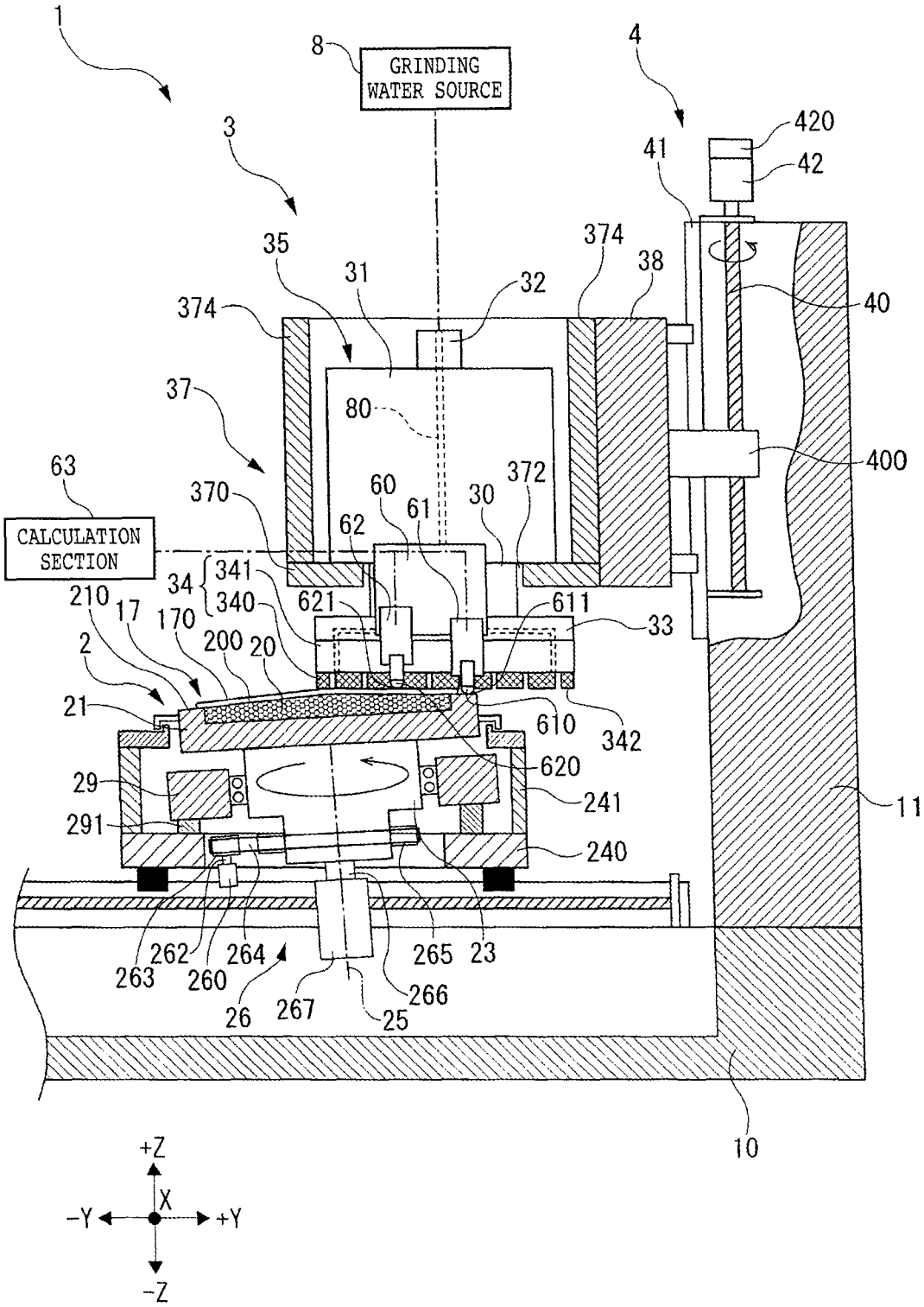
FIG. 3 is a sectional view of the grinding apparatus grinding the wafer.

In a state in which the first contact element 610 is in contact with the upper surface 210 of the frame body 21 and the second contact element 620 is in contact with the upper surface 170 of the wafer 17, the grinding unit 3 is further lowered in the −Z direction by use of the grinding feeding mechanism 4. As a result, as depicted in FIG. 3, the lower surfaces 342 of the grindstones 340 make contact with the upper surface 170 of the wafer 17. Here, the contact part between the lower surfaces 342 of the grindstones 340 and the upper surface 170 of the wafer 17 is the processing region 9 depicted in FIG. 2. In a state in which the lower surfaces 342 of the grindstones 340 are in contact with the upper surface 170 of the wafer 17, the grindstones 340 are further lowered in the −Z direction by use of the grinding feeding mechanism 4, whereby the wafer 17 is ground.

During grinding of the wafer 17, the measurement of the height of the holding surface 200 by the first height gauge 61 and the measurement of the height of the upper surface 170 of the wafer 17 by the second height gauge 62 are continued, and calculation of the thickness of the wafer 17 performed by the calculation section 63 on the basis of the difference between the two heights is continued.

In the grinding apparatus 1, the first measurement point 611 and the second measurement point 621 are located in the vicinity of the processing region 9 where the upper surface 170 of the wafer 17 and the lower surfaces 342 of the grindstones 340 make contact as depicted in FIG. 2, and, thus, the thickness of the vicinity of the ground part of the wafer 17 can be measured, and fine variation in the thickness of the wafer 17 can be recognized, enabling accurate measurement of the thickness. Particularly, as depicted in FIG. 2, when the first measurement point 611 and the second measurement point 621 are located on the downstream side in regard of the rotating direction of the chuck table 2 as compared to the processing region 9, the thickness of the ground part that is obtained immediately after grinding can be measured, and, thus, formation of the wafer 17 in a predetermined thickness can be recognized by the calculation section 63 immediately after such measurement, and the wafer 17 can be finished to a predetermined thickness.

In addition, since the first height gauge 61 and the second height gauge 62 are disposed on the side plate 374 of the holder 37, it is possible, by bringing the grindstones 340 close to the upper surface 170 of the wafer 17 by use of the grinding feeding mechanism 4, to simultaneously lower the first height gauge 61 and the second height gauge 62. Further, since both height gauges are separated away from the upper surface 170 of the wafer 17 together with the grindstones 340 when the grindstones 340 are separated away from the upper surface 170 of the wafer 17 by use of the grinding feeding mechanism 4, operability of maintenance work and the like can be enhanced.

When the wafer 17 has been ground to a predetermined thickness, the grinding unit 3 is moved in the +Z direction by use of the grinding feeding mechanism 4 to separate away the grindstones 340 from the upper surface 170 of the wafer 17, and the grinding of the wafer 17 is ended.

Figure 4:
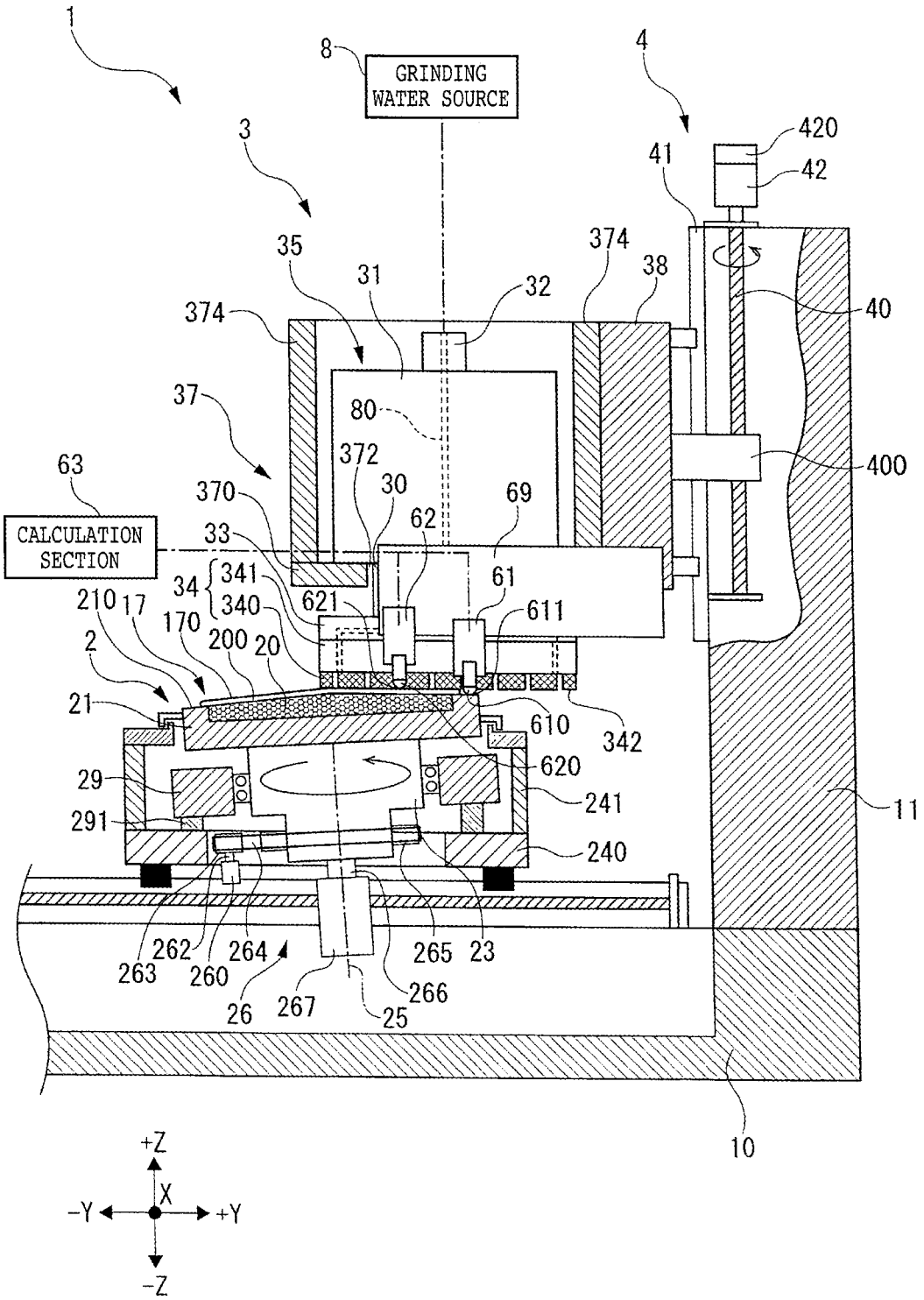
FIG. 4 is a sectional view of the grinding apparatus grinding the wafer.
Figure 5:
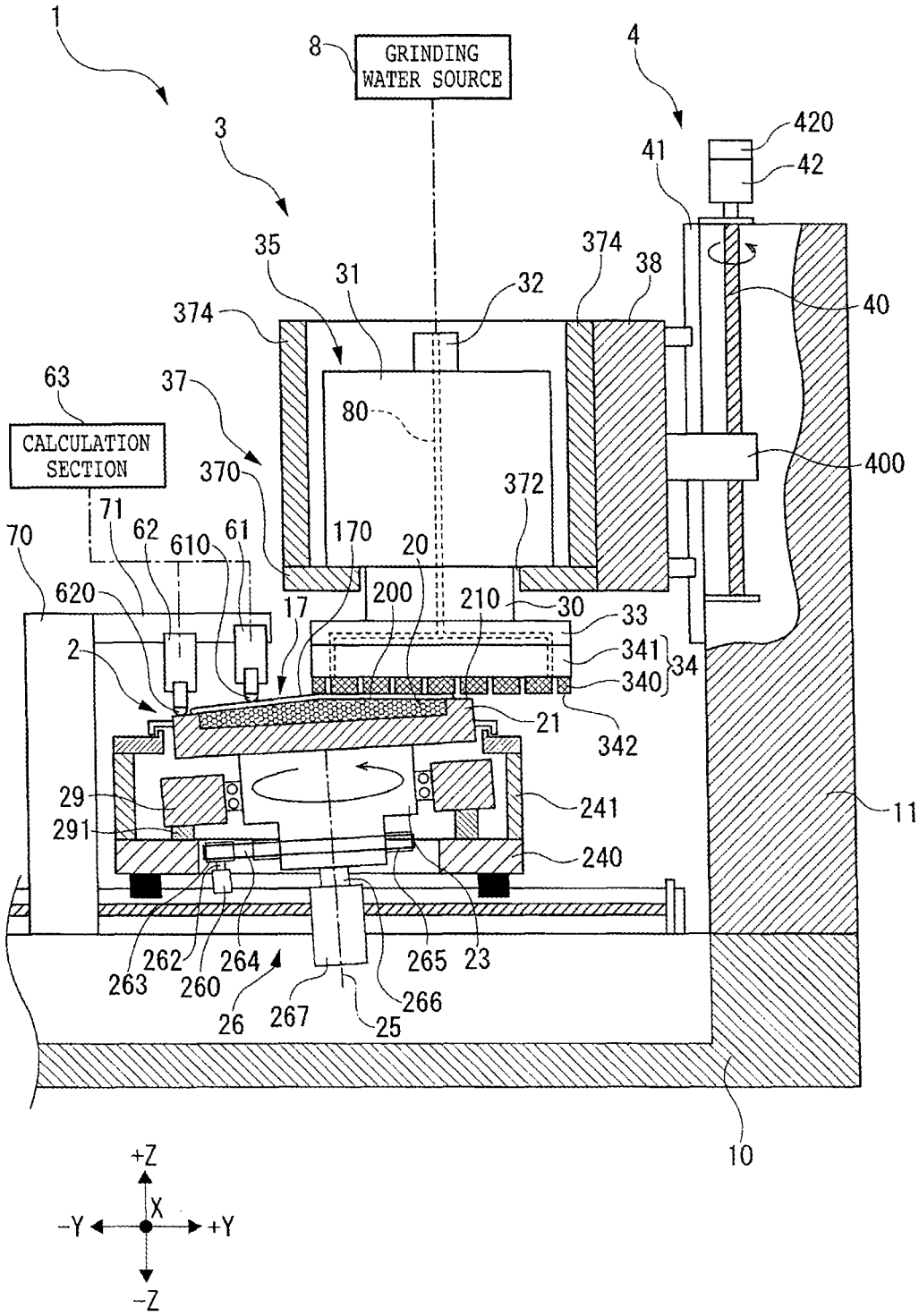
FIG. 5 is a sectional view depicting an example of a conventional grinding apparatus.
Figure 6:
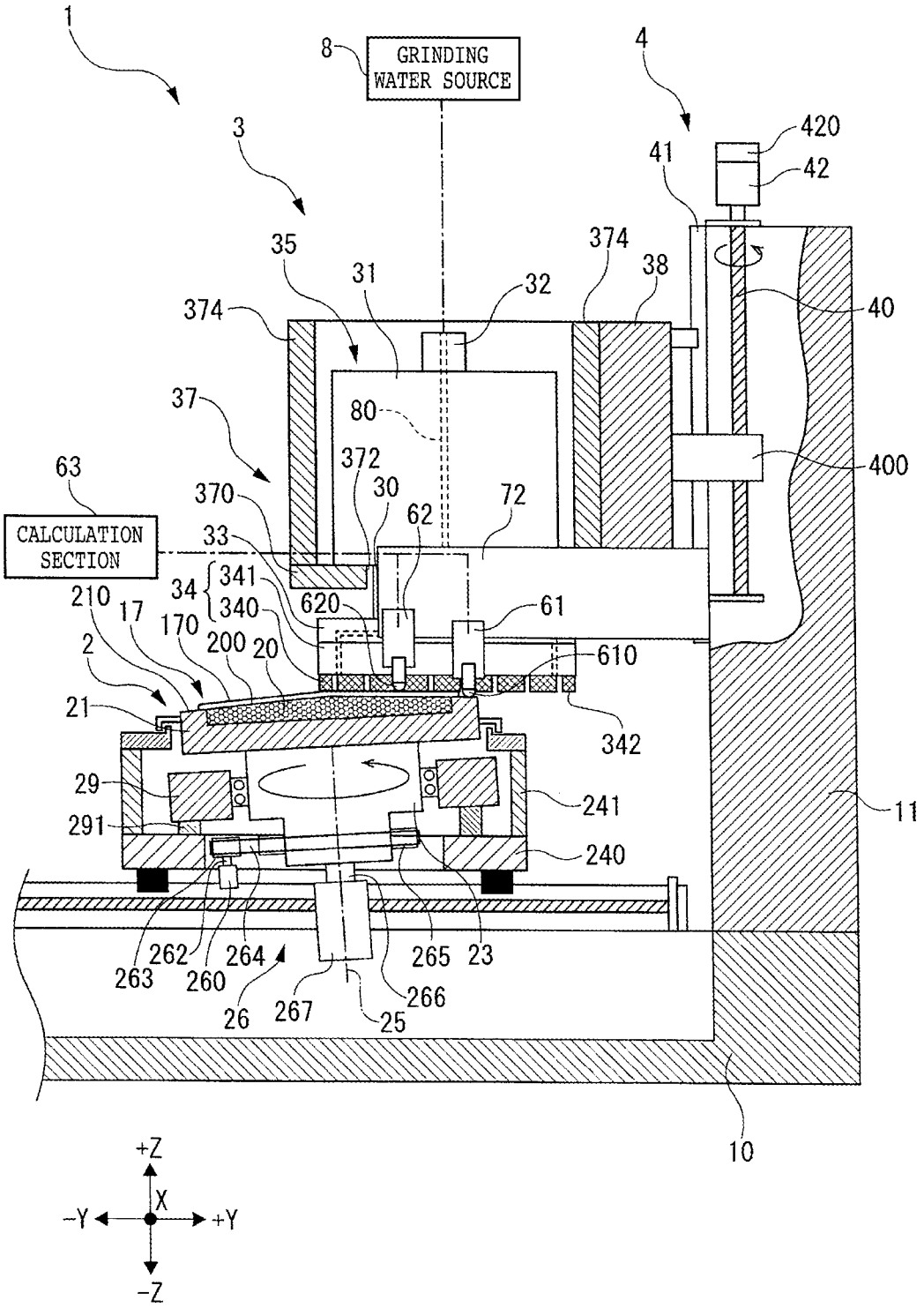
FIG. 6 is a sectional view depicting an example of a conventional grinding apparatus.

Instead of the configuration in which the first height gauge 61 and the second height gauge 62 are provided at the connection section 60 supported by the side plate 374 of the holder 37, the grinding apparatus 1 may have a configuration in which, as depicted in FIG. 4, an arm 69 fixed to the slider 38 is provided, and the first height gauge 61 and the second height gauge 62 are supported by the arm 69. In this configuration, also, the first height gauge 61 and the second height gauge 62 supported by the arm 69 are located at horizontal positions similar to the horizontal position of the first height gauge 61 and the horizontal position of the second height gauge 62 that are depicted in FIG. 1. Thus, the first height gauge 61 and the second height gauge 62 are located in the vicinity of the processing region 9 depicted in FIG. 2, and, accordingly, the thickness of the vicinity of the ground part of the wafer 17 can be measured, enabling accurate measurement of the thickness of the wafer 17.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus comprising:

a chuck table that holds a wafer on a holding surface;

a grinding unit that has a spindle unit in which a spindle with a plurality of grindstones arranged in an annular pattern having an outer periphery mounted to a tip thereof is rotatably supported and a holder supporting the spindle unit and that grinds the wafer by use of the plurality of grindstones;

a grinding feeding mechanism that has a slider supporting the holder and that moves the grinding unit into grinding feeding in a grinding feeding direction perpendicular to the holding surface;

a first height gauge that measures a height of the holding surface;

a second height gauge that measures a height of an upper surface of the wafer held on the holding surface; and a calculation section that calculates a difference between the height of the holding surface measured by the first height gauge and the height of the upper surface of the wafer measured by the second height gauge, as a thickness of the wafer, wherein the first height gauge and the second height gauge are mounted on a connection section supported by the holder or an arm fixed to the slider, and are disposed outside the periphery of the plurality of grindstones, wherein the grinding unit is operably connected to the grinding feeding mechanism such that the grinding unit is lowered in a direction approaching the holding surface by the grinding feeding mechanism, and wherein the first height gauge and the second height gauge are operably connected to the grinding unit through the connection section or arm and are simultaneously lowered with the grinding unit in the direction approaching the holding surface by the grinding feeding mechanism.

2. The grinding apparatus according to claim 1, wherein the grinding unit includes the holder having a support plate that has an opening for exposing a lower portion of the spindle and that supports the spindle, and a side plate erected from a periphery of the support plate and supporting the connection section, and the first height gauge and the second height gauge are disposed on the connection section such that a first measurement point of the first height gauge and a second measurement point of the second height gauge are positioned in a vicinity of a processing region where the plurality of grindstones grind the wafer.

3. The grinding apparatus according to claim 1, wherein, when the grinding unit is lowered in the direction for approaching the holding surface by the grinding feeding mechanism, the first height gauge measures the height of the holding surface and the second height gauge measures the height of the upper surface of the wafer, before a grindstone of the plurality of grindstones comes into contact with the wafer.

4. A grinding apparatus comprising:

a chuck table that holds a wafer on a holding surface;

a grinding unit that has a spindle unit in which a spindle with a plurality of grindstones arranged in an annular pattern having an outer periphery mounted to a tip thereof is rotatably supported and that grinds the wafer by use of the plurality of grindstones, the grinding unit comprising an arc surface extending radially outside the periphery of the plurality of grindstones;

a grinding feeding mechanism that moves the grinding unit into grinding feeding in a grinding feeding direction perpendicular to the holding surface;

a first height gauge that measures a height of the holding surface;

a second height gauge that measures a height of an upper surface of the wafer held on the holding surface; and a calculation section that calculates a difference between the height of the holding surface measured by the first height gauge and the height of the upper surface of the wafer measured by the second height gauge, as a thickness of the wafer, wherein the first height gauge and the second height gauge are disposed on the arc surface of the grinding unit and simultaneously move with the grinding unit that is controlled by the grinding feeding mechanism.

* * * * *